US005347927A

United States Patent [19]

Berna et al.

[11] Patent Number: 5,347,927

[45] Date of Patent: Sep. 20, 1994

[54] ANISOTROPIC ENDLESS PRINTING ELEMENT AND METHOD FOR MAKING THE SAME

[75] Inventors: Claude Berna, Moosch, France; Dennis O'Rell, Boxboro, Mass.; Herve Praet, Mulhouse; Gerard Rich, Orschwihr, both of France; Richard Rodgers, Hudson, Mass.; Jean P. Stutz, Vieux Thann, France

[73] Assignee: W. R. Grace & Co.-Conn., New York, N.Y.

[21] Appl. No.: 58,067

[22] Filed: May 4, 1993

[51] Int. Cl.[5] ..... B41N 1/12

[52] U.S. Cl. ..... 101/401.1; 101/375; 428/213; 428/214; 492/28; 138/154

[58] Field of Search ..... 101/401.1, 375, 217, 101/395; 428/213, 214, 215, 222, 304.4, 306.6, 301, 68, 71; 156/294; 492/28, 43, 52, 54; 138/154

[56] References Cited

U.S. PATENT DOCUMENTS

| | | | |
|---|---|---|---|
| 1,528,956 | 3/1925 | Smith . | |
| 1,659,371 | 2/1928 | Merrill . | |
| 3,146,709 | 9/1964 | Bass et al. | 101/375 |
| 3,147,698 | 9/1964 | Ross . | |
| 3,445,906 | 5/1969 | Mitchell, Jr. . | |
| 3,467,009 | 9/1969 | Ross | 101/216 |
| 3,578,544 | 5/1971 | Thorsrud . | |
| 3,629,047 | 12/1971 | Davison . | |
| 3,881,045 | 4/1975 | Strunk | 428/215 |
| 3,978,254 | 8/1976 | Hoexter et al. | 101/375 |
| 3,983,287 | 9/1976 | Goossen et al. | 428/241 |
| 4,043,142 | 8/1977 | Marshall | 66/170 |
| 4,048,368 | 9/1977 | Hale et al. | 428/235 |
| 4,093,764 | 6/1978 | Duckett et al. | 428/301 |
| 4,174,244 | 11/1979 | Thomas et al. | 156/242 |
| 4,198,739 | 4/1980 | Budinger et al. . | |
| 4,202,850 | 5/1980 | Yamamoto et al. | 264/108 |
| 4,303,721 | 12/1981 | Rodriguez | 428/213 |
| 4,368,568 | 1/1983 | Watanabe . | |
| 4,471,011 | 9/1984 | Spöring | 428/68 |
| 4,547,453 | 10/1985 | Worns et al. | 430/271 |
| 4,549,923 | 1/1985 | Tachibana et al. | 156/423 |
| 4,554,040 | 11/1985 | van der Velden | 156/215 |
| 4,574,697 | 3/1986 | Feeley | 101/401.1 |
| 4,684,600 | 8/1987 | Worns et al. | 430/271 |
| 4,812,357 | 3/1989 | O'Rell et al. | 428/246 |
| 4,903,597 | 2/1990 | Hoage et al. | 101/401.1 |
| 5,066,537 | 11/1991 | O'Rell et al. | 428/246 |
| 5,131,325 | 7/1992 | Blauvelt | 101/375 |
| 5,188,273 | 2/1993 | Schmoock | 226/190 |
| 5,205,213 | 4/1993 | Bresson | 101/217 |
| 5,215,013 | 6/1993 | Vrotacoe et al. | 101/217 |

FOREIGN PATENT DOCUMENTS

| | | | |
|---|---|---|---|
| 1530504 | 11/1978 | Canada | 101/375 |
| 2012376 | 9/1990 | Canada | 101/119 |
| 2026954 | 4/1991 | Canada | 101/59 |

OTHER PUBLICATIONS

Ser. No. 07/699668 Dec. 9, 1991 Vrotacol et al.

*Primary Examiner*—Eugene H. Eickholt

*Attorney, Agent, or Firm*—Craig K. Leon; William L. Baker

[57] ABSTRACT

An exemplary anisotropic printing element comprises an outer printing surface layer and, located radially beneath the outer layer, a spirally-integrated reinforced compressible tubular structure comprising a reinforcing sheet having synthetic fibers, the sheet being spirally wrapped at least two complete turns circumferentially around the longitudinal axis of the tubular structure, thereby defining an inner tubular surface on a radially inward wrapped sheet portion and an outer tubular surface on a radially outward wrapped sheet portion, the tubular structure further comprising an elastomer having voids, the elastomer being disposed between the inner and outer tubular surfaces defined by the wrapped sheet portions, the void-containing elastomer thereby providing radial compressibility to and being spirally-integrated within the tubular structure. Examplary methods for fabricating the printing elements of the invention are also disclosed.

39 Claims, 4 Drawing Sheets

ANISOTROPIC ENDLESS PRINTING ELEMENT AND METHOD FOR MAKING THE SAME

BACKGROUND OF THE INVENTION

A. Field of the Invention

The present invention relates to printing blankets of the type used in printing and offset lithography, and more particularly to a novel anisotropic endless printing element having a spirally-integrated reinforced compressible tubular structure, and to a method for making the same.

B. Description of Related Art

The printing roll of Ross (U.S. Pat. No. 3,467,009) provided volume compressibility, i.e. an ability to compress in thickness without substantial increases in lateral dimensions. The roll was made by saturating an elastomer into a felted web composed of short fibers of paper or cotton linters.

In contrast to printing rolls, printing "blankets" were first so-called because they employed sheet layers in the manner of a blanket. Blanket ends were clamped into a longitudinal cylinder gap and held tightly in position over a carcass layer or sublayer. For example, the printing blanket of Duckett et al. (U.S. Pat. No. 4,093,764) employed alternating layers of short compressed fibers with elastomer. The printing blankets of Rodriguez (U.S. Pat. No. 4,303,721) and O'Rell et al. (U.S. Pat. No. 4,812,357) used separate foamed layers and stabilizing hard elastomer layers to enhance web feed characteristics and dynamic stability.

Circumferentially seamless or "endless" printing blankets have been developed in conjunction with gapless cylinders. Endless blankets are believed by the present inventors to provide advantages over prior an blankets used on gapped cylinders because they allow printing over the entire outer surface and help to minimize vibration at high rotational speeds. However, their multi-layered construction requires many manufacturing steps and close tolerances. For example, the blanket of Gaffney et al. (Can. Pat. App. 2,026,954) used separate foam, hard rubber, and optional fabric layers. The blanket of Bresson (U.S. Pat. No. 5,205,213) employed a stabilizing hard elastomer between the printing and foam layers. The blanket of Vrotacoe et al. (EP No. 92810364.7) disclosed a filament wound, elastomeric seamless blanket having a number of layers. The trend therefore appears very much to be towards having concentric, separated, layered, complex structures.

SUMMARY OF THE INVENTION

The present invention provides a novel anisotropic endless printing element and a method for making the same.

The term "anisotropic" as used herein means that the printing element permits radial compression, in a direction perpendicular to the rotational axis of the tubular printing element, and resilient recovery therefrom, while at the stone time providing structural reinforcement to resist stretching and distortion in the circumferential direction around the rotational axis, thereby providing dynamic stability.

Instead of using separate compressible layers and reinforcing layers (e.g., fabrics, hard elastomers, etc.) which are separately formed into concentric tubes around the rotational axis, the endless printing element of the present invention achieves the aforementioned anisotropic properties using a "spirally-integrated" reinforced compressible tubular structure. An exemplary spirally-integrated structure comprises a reinforcing sheet, preferably a nonwoven layer of randomly-oriented continuous or discontinuous (staple) fibers foraging a three-dimensional matrix having openings and interstices, wound at least two complete turns around the rotational axis, and a void-containing elastomer between the outward and inward cylindrical wall surfaces defined by the spirally wrapped sheet. In further exemplary embodiments, the void-containing elastomer is located within the three-dimensional matrix of a nonwoven sheet, between the sheet windings, or both within and between the sheet windings.

One of the purposes of the invention is thus to provide excellent dynamic stability such that the circumferential or angular velocity of the surface printing layer is not altered in passing through the nip between the printing element and an opposed cylinder or plate. The uniformity of the velocity at which the printing surface passes through the nip is important to achieving web control (i.e. the printed material does not slip relative to the rotating blanket) and to achieving good image resolution during rotation (i.e. no smearing of the image or distortion in the printing element surface ).

Another purpose of the invention is to provide a circumferentially endless printing element and methods of fabrication involving minimal assembly steps.

Another propose of the invention is to combine simultaneously within a spirally-integrated structure the two properties of radial compressibility and circumferential resistance to distortion (i.e. bulges, ripples, etc.).

An exemplary printing element of the invention comprises a seamless outer printing layer, and, located radially beneath the outer layer, at least one spirally-integrated reinforced compressible tubular structure comprising a sheet having synthetic fibers and a void containing elastomer, said sheet being spirally wrapped at least two complete turns circumferentially around the longitudinal axis of the tubular structure and thereby defining an inner tubular surface on a radially inward wrapped sheet portion and defining an outer tubular surface on a radially outward wrapped sheet portion. The tubular structure further comprises a void-containing elastomer disposed between the inner and outer tubular surfaces defined by the wrapped sheet portions, the void-containing elastomer thereby being spirally-integrated within and providing radial compressibility to the tubular structure.

In another exemplary tubular structure of the invention, a stratified spirally-integrated tubular structure is created by spirally wrapping, using at least three complete turns circumferentially around the longitudinal rotational axis, a laminate comprising a reinforcing sheet and a layer of elastomer which either contains voids or is foamable such that it contains voids after being cured. The stratified layers of the tubular reinforced compressive structure can therefore be made of two sheet structures that are spirally-integrated.

An exemplary method of the invention comprises the steps of providing a tubular from comprising a cylinder, mandrel, or carrier sleeve, forming a spirally-integrated reinforced compressible tubular structure thereabout by spirally wrapping, using at least two complete turns circumferentially around the longitudinal axis of the tubular form, a sheet having synthetic fibers, the spiral wrapping thereby defining an inner tubular surface on a radially inward wrapped portion of said sheet and defining an outer tubular surface on a radially outward wrapped portion of the sheet, and disposing an elastomer between the inner and outer tubular surfaces defined by the inward and outward spirally-wrapped sheet portions, and curing said elastomer so that in its cured form the elastomer contains voids and is spirally-integrated within the tubular structure.

Further exemplary blankets and methods of the invention are discussed hereinafter.

BRIEF DESCRIPTION OF THE DRAWINGS

Further characteristics and advantages of the invention will become more readily apparent when the following detailed description is considered in conjunction with the annexed drawings, provided by way of example, wherein

FIGS. 1–13 are photographic enlargements of an exemplary "anisotropic foam" layer of the invention.

DETAILED DESCRIPTION OF EXEMPLARY EMBODIMENTS

Figure 1:
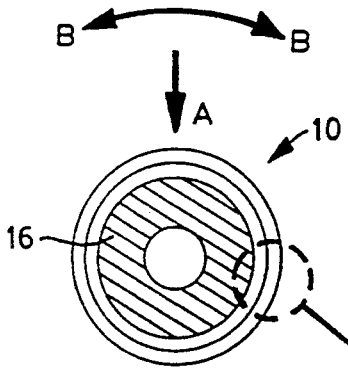
FIG. 1 is a cross-sectional diagram of an exemplary anisotropic endless printing element of the invention mounted around a cylinder.

FIG. 1 shows an exemplary anisotropic endless printing element 10 of the invention, mounted around an optional cylinder 16. For illustrative purposes, a cylinder, which can be solid or hollow, is shown in FIG. 1. Radially compressive forces, as discussed herein, namely those which are directed towards the rotational axis of the tubular printing element, are indicated by arrow A. Circumferential forces around the rotational axis of the printing element 10 are indicated by arrow B.

Figure 2:
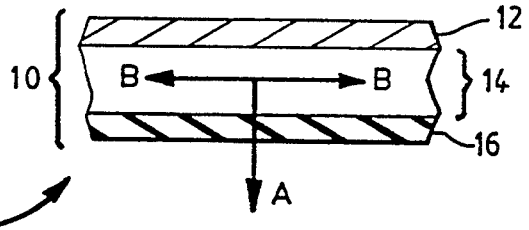
FIG. 2 is an enlarged partial diagram of the exemplary printing element of FIG. 1.

As seen in the partial view of FIG. 2, the printing element 10 comprises an outer lithographic or printing surface layer 12, at least one spirally-integrated reinforced compressible tubular structure 14, and an optional cylinder, mandrel, or tubular carrier, as designated at 16. The spirally-integrated tubular structure 14 allows simultaneously for radially compressive forces (arrow A) and reinforcement to resist circumferential distortion (arrow B) within tile same structure 14. A tubular carrier, as will be further discussed herein, can also be located between the spirally-integrated structure 14 and cylinder 16.

Figure 3:
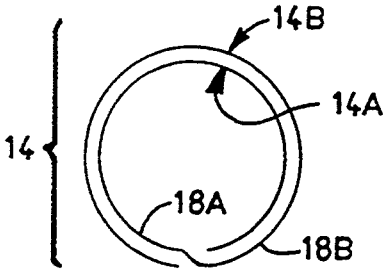
FIG. 3 is an cross-sectional diagram of an exemplary spirally-integrated reinforced compressible tubular structure of the invention.

The seamless outer lithographic or printing surface layer 12 may be formed in a sleeve-like (or tubular) shape comprising suitable materials, such as natural or synthetic robber, as known in the lithographic and printing art. The outer surface layer 12 preferably has a radial thickness of 0.05 to 0.6 mm., although a range of 0.1 to 0.4 min. is more preferred. The surface layer 12 is preferably void-free, FIG. 3 shows an exemplary spirally-integrated reinforced compressible tubular structure 14 that is fabricated prior to adding the outer layer 12 (FIGS. 1 and 2). The structure 14 comprises a sheet 18 having synthetic fibers. The sheet 18 is spirally-wrapped at least two complete turns circumferentially around the longitudinal axis of the tubular structure, thereby defining an inner tubular surface 14A on a radially inward wrapped sheet portion 18A and defining an outer tubular surface 14B on a radially outward wrapped sheet portion 18B. The tubular structure 14 further comprises a void-containing elastomer between the inner 14A and outer 14B tubular surfaces which provides radial compressibility within the spirally-integrated structure 14.

The void-containing elastomer can be located within and/or between the sheet portions 18A/18B. If the void-containing elastomer is located within the sheet 18 (e.g., a porous woven or nonwoven fabric), the sheet portions 18A and 18B are in physical contact with each other. If the sheet is impregnated with elastomer such that the elastomer is allowed to expand beyond the thickness of the sheet, then the sheets may be visibly separated or "stratified" into discrete layers.

Figure 4:
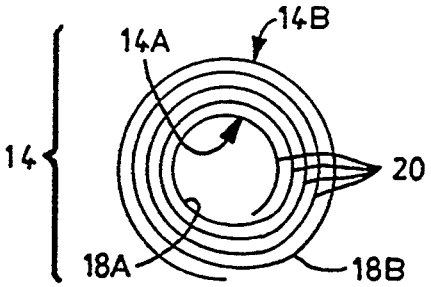
FIG. 4 is a cross-sectional diagram of another exemplary spirally-integrated reinforced compressible tubular structure of the invention, wherein a spirally wound elastomer layer is intertwined with a spirally wound reinforcing sheet.

A further exemplary printing element 10 comprises a stratified spirally-integrated reinforced compressible tubular structure 14, as shown in FIG. 4, wherein the sheet 18 is spirally wrapped at least three complete turns, and more preferably five to fifteen turns or more (depending on final desired thickness) circumferentially around the longitudinal axis of the tubular structure 14, thereby defining a radially innermost sheet portion 18A, a radially outermost sheet portion 18B, and at least one intermediate sheet portion (or winding) located radially between said innermost 18A and outermost 18B sheet portions, and a void containing elastomer 20 being disposed between the innermost sheet portion 18A, the at least one intermediate sheet portion, mid the outermost sheet portion 18A, thereby forming a stratified spirally-integrated tubular structure 14.

Exemplary sheets 18 may comprise a woven or nonwoven structure having synthetic fibers or filaments. (The terms "fibers" and "filaments" are used synonymously herein.) Continuous fibers are preferred. The synthetic material preferably has a high modulus of elasticity, and may be composed of a polyester, polyamide, aromatic polyamide, polyolefin, polyvinyl chloride, polyvinyl chloride copolymer, rayon, vinylidene chloride, an aramid, graphite, glass, metal, or a mixture of the foregoing.

Figure 5:
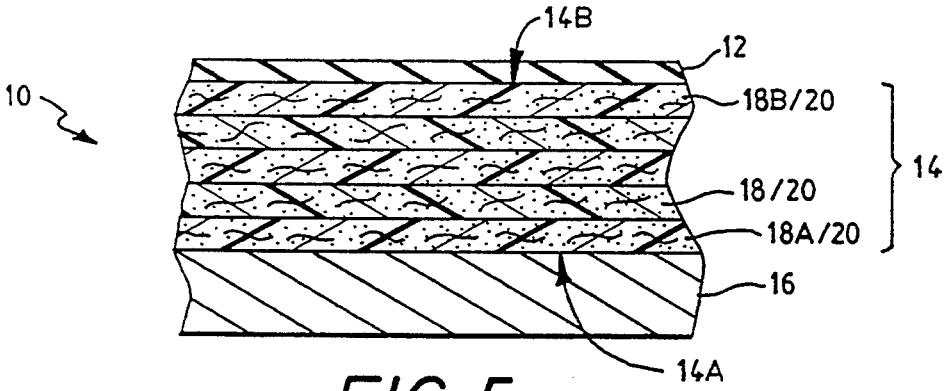
FIGS. 5–8 are partial cross-sectional diagrams of further exemplary printing elements of the invention.

FIG. 5 is a cross-sectional diagram of another exemplary printing element 10 shown with an optional tubular carrier 16. The spirally-integrated reinforced compressible structure 14 may comprise a nonwoven sheet 18 (as further described hereinafter) that contains a void-containing elastomer (designated as 18/20) such that the void-containing elastomer 20 is located between the tubular innermost sheet portion or winding 14A and outermost sheet portion or winding 14B. Intervening layers, such as adhesive layers, fabric layers, foam layers, and elastomers may be placed between the surface layer 12, spirally-integrated structure 14, and carrier 16.

It may be noted in conjunction with FIG. 5 that an exemplary carrier 16 may comprise a knitted, woven, or nonwoven sheet impregnated with an elastomer that does not contain voids. In further exemplary embodiments, the sheet 18 of the reinforced compressible structure 14 may be a portion of one continuously spirally-wound sheet, the radially rearmost sheet windings being filled with a void-free elastomer and the outermost sheet windings being filled with and/or separated by a void-containing elastomer.

Figure 6:
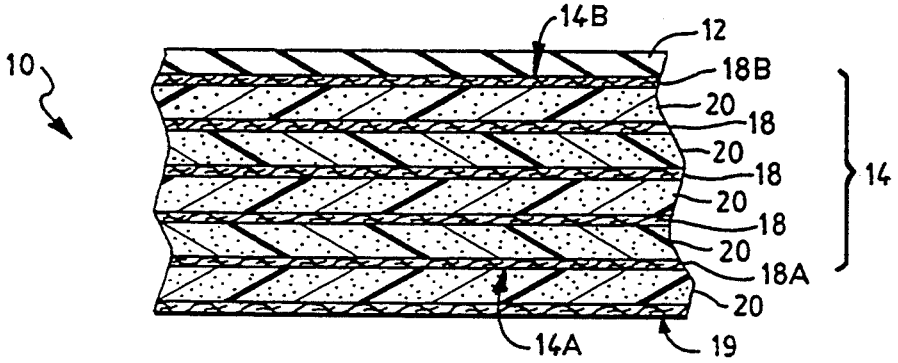

FIG. 6 illustrates a further exemplary printing element 10 wherein the spirally-integrated reinforced compressible tubular structure 14 comprises a woven fabric sheet 18 (e.g., nylon) that is spirally wound around the rotational axis of the tubular printing element with a layer of elastomer 20 that contains voids or a blowing agent which is activated during curing to produce voids. Whether the sheet 20 shown in FIG. 6 is a thin woven fabric or a porous nonwoven fabric, the elastomer layer 20 may be superimposed upon either side of the sheet 18. For example, FIG. 6 shows the fabric 18 outermost in the spiral wrapping, such that an outer sheet portion 18B is positioned radially outward of the void-containing elastomer. The respective lengths of the sheet 18 and elastomer layer 20 may be different. For example, if a longer sheet of fabric is used it can be wrapped first, such that the reinforced compressible tubular structure 14 has a sheet portion (as designated at 19) on its inner tubular surface, as well as a sheet portion 18B on its outermost tubular surface.

Figure 7:
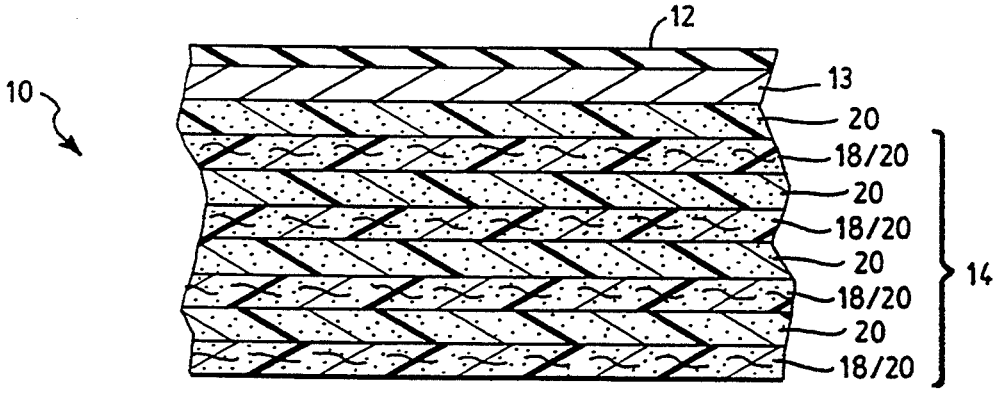

FIG. 7 illustrates a further exemplary printing element 10 in which an exemplary spirally-integrated structure 14 comprises a nonwoven sheet 18 containing a void-containing elastomer 20 (both designated at 18/20) that is spirally wrapped with an elastomer that contains voids 20. An optional intervening layer (e.g., unreinforced rubber) is also shown at 13.

Figure 8:
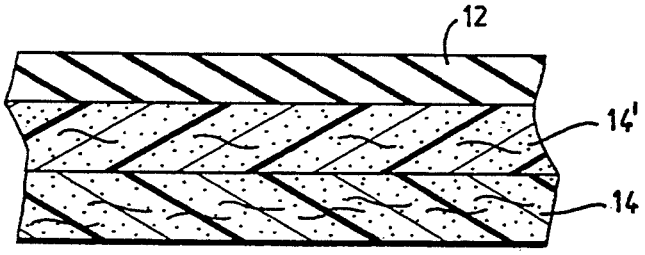

FIG. 8 illustrates a further exemplary printing element 10 having two spirally-integrated reinforced compressible layers 14 and 14'. For example, the radially outermost tubular structure 14' may comprise an elastomer having a higher void content than the inner structure 14. Conversely, structure 14 may have a greater stiffness, such as by having a harder elastomer (e.g., higher content of carbon black). The spirally-integrated structures 14 and 14' be fabricated from the same multi-spirally-wound sheet.

For example, a layer of elastomer having a predetermined amount of blowing agent may be superimposed upon a first portion of a sheet, and a layer of elastomer having a greater amount of blowing agent is superimposed upon a second latter portion of the sheet. The sheet is then wound, beginning with the first portion, then cured to activate the blowing agent.

A preferred reinforcing sheet 18 comprises a nonwoven material (fabric) prepared from randomly-oriented synthetic filaments, forming a highly porous three-dimensional matrix having openings and interstices. The porosity should be such that an elastomer or void-containing elastomer can be contained within the three-dimensional matrix. Nonwoven sheets may comprise short (staple) or continuous fibers (the word "filament" may hereinafter be used synonymously with "fiber"). Preferred nonwovens are made by extruding the synthetic material, e.g. polyester, through "spinnerets" onto a moving carrier in random fashion. Such fiber strands are continuous and randomly oriented with respect to the direction of the moving carrier or belt. Fibers produced by this process are viewed as having their lengths randomly oriented yet generally parallel to the moving carrier, and are termed "spunbonded" or "spunlaid" because they are spun, laid, and usually bonded, such as by heat, to each other. Other preferred nonwovens, such as those made from aramid fibers, are wet-laid onto a mat, and the fibers are mechanically interlaced or bonded together using adhesive. Continuous nonwovens are surprisingly advantageous because of their strength and porosity.

Preferred elastomers 20 for the spirally-integrated reinforced compressible structure 14 include natural robber, synthetic robbers such as nitrite robber, polyisoprene, polybutadiene, butyl rubber, styrene-butadiene copolymers and ethylene-propylene copolymers, polyacrylic polymers, polyurethanes, epichlorohydrins, chlorosulfonated polyethylenes, silicone rubbers, fluorosilicone robbers, or a combination thereof. Nitrile robber is preferred. Elastomers may be compounded with additives such as fillers. stabilizers, pigments, bonding agents, plasticizers, cell or void forming agents. crosslinking or vulcanizing agents using techniques, quantities, and equipment which are known to those skilled in the art. See e.g., U.S. Pat. Nos. 4,303,721 and 4,812,357. For example, carbon black is known to improve tensile strength, while chemical blowing agents can be used to generate voids in the elastomer during curing.

As previously stated, the elastomer 20 located between the inner and outer walls 14A and 14B of the spirally-integrated tubular structure 14 (e.g. FIG. 5) may be placed within the sheet portions 18A and 18B and/or between them (e.g. FIGS. 6 and 7). A number of exemplary methods can be employed for disposing a void-containing elastomer 20 within the three-dimensional matrix of the sheet 18. Although sheets comprising nonwovens having continuous synthetic fibers are preferred, the following described methods are also suitable for use with felted (short) fiber nonwovens.

One such exemplary method for incorporating a void-containing elastomer within the three-dimensional matrix of a nonwoven comprises the steps of providing a nonwoven sheet 18, saturating the sheet in a water-based latex comprising an elastomer (e.g., nitrile robber with curing agents, plasticizers, etc.), and squeezing the saturated sheet to remove some of the saturant. The saturated sheet, preferably while still wet, is spirally wound at least two complete turns, and more preferably between three to fifteen turns (depending upon final desired thickness) around a tubular form, such as a cylinder 16, mandrel, or tubular carrier. The saturated, wound structure is dried and the elastomer is cured by known means, such as by wrapping the spirally-wound structure within strips of cotton or nylon and placing it into a vulcanizer (e.g., oven) or autoclave using temperatures and pressures as would be known by those skilled in the art. After curing, the cotton or nylon wrapping is removed. The cured structure 14 contains open, interconnected voids, thereby allowing the spirally-integrated tubular structure 14 to be compressible. The desired void volume will depend upon the void volume of the nonwoven and the amount of latex squeezed out as excess saturant, and this amount can be varied according to desire. After curing, the resulting spirally-integrated reinforced compressible structure 14 is preferably ground to ensure uniform circularity. The outer printing layer 12, as well as any optional intervening layers, (e.g., fabric, foam, hard rubber, etc.), are applied thereafter.

Figure 9:
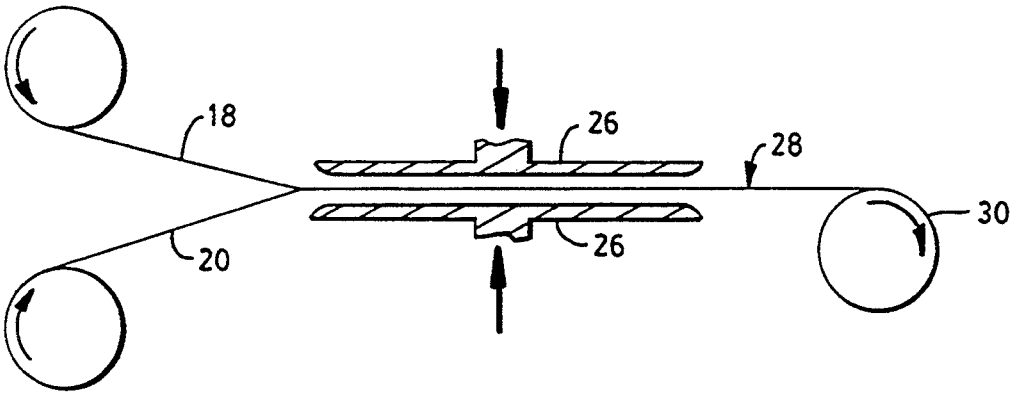
FIGS. 9–11 are diagrams of exemplary methods for impregnating nonwoven fabric sheets with an elastomer.

A further exemplary method for incorporating a void-containing elastomer into the nonwoven sheet 18 is shown in FIG. 9. The method comprises the step of pressing together a sheet 18 and a sheet of uncured elastomer 20 (e.g., a compounded nitrile robber with curing and blowing agent mixed into the robber).

Known blowing agents can be incorporated in the elastomer, prior to impregnation into the sheet 18, such that the elastomer can be foamed within the three-dimensional sheet matrix. Preferably, blowing agents are activated at about 200°–315° F. Blowing agents that generate nitrogen or carbon dioxide gases are preferred. Examples of blowing agents that may be used are magnesium sulfate, hydrated salts, hydrazides, and carbonamides. It is also believed that nitrate, nitrite, bicarbonate and carbonate salts can be used. A blowing agent, comprising p,p'-oxybis (benzene sulfonyl hydrazide), is available from Uniroyal Chemicals under the tradename CELOGEN TM O.T., and is suitable for the proposes contemplated herein.

As seen in FIG. 9, the elastomer 20 containing a blowing agent is impregnated into the openings and interstices of the sheet 18 by using opposed or nipped surfaces, designated at 26. Heated opposed cylinders, rotatable rollers, curved, or plate-like surfaces are used for thermally softening the elastomeric material 20 and working it into the nonwoven. The impregnated nonwoven 28 is then rolled onto a takeup roll 30. Preferably, the uncured elastomer sheet 20 is sufficiently thick such that, after the nonwoven sheet 18 is spirally wound and cured, both sides of each sheet portion (or winding) are filled. The impregnated nonwoven sheet 28 is preferably passed between the heated rolls or plates 26 two to four times to ensure that its openings and pores are filled.

The exemplary method of FIG. 9 can be used for forming interconnected, open voids as well as for forming disconnected closed voids. However, the inventors have surprisingly discovered that the method is particularly suited for forming substantially disconnected spherical voids and for encapsulating the fibers within the elastomer 20 such that the voids and fibers do not coincide. These features are believed to render the resultant spirally-integrated structure 14 highly resilient and extremely durable.

Thus, a further exemplary spirally-integrated reinforced compressible tubular structure 14 of the invention comprises an elastomer which encapsulates the fibers or filaments (preferably continuous) of the nonwoven and contains substantially disconnected spherical voids formed within the three-dimensional matrix of the nonwoven sheet.

Figure 12:
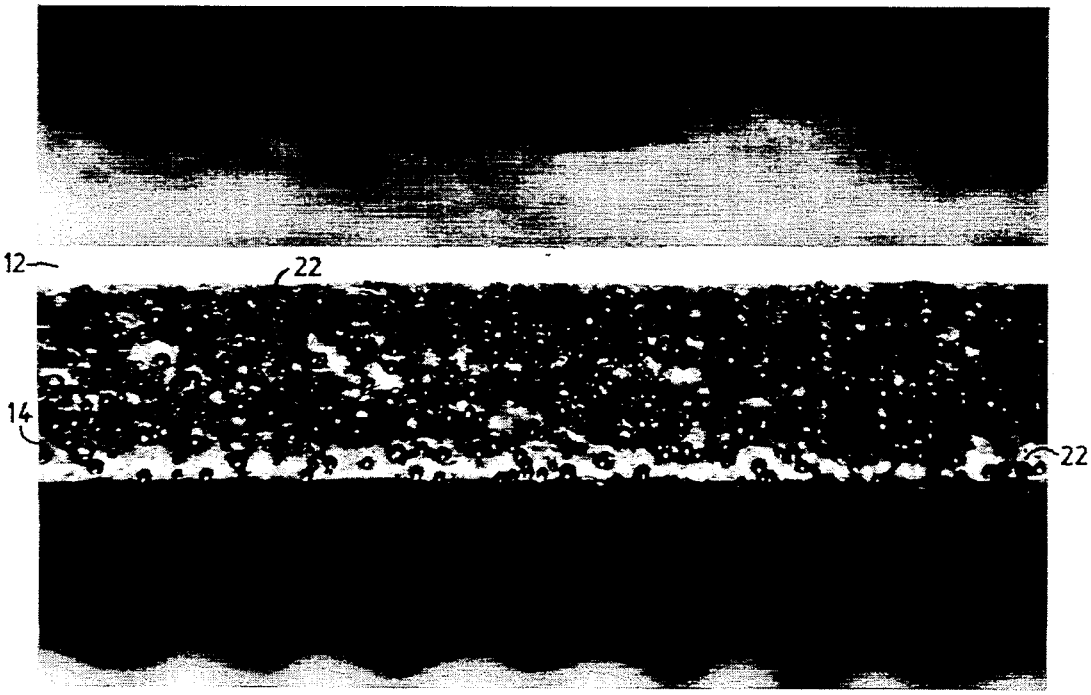

FIG. 12 is an enlarged photograph of an exemplary "anisotropic foam" layer 14 (i.e. spirally-integrated nonwoven having a void-containing elastomer) of the invention wherein voids 22 are substantially spherical and disconnected. This foam layer (the tubular spirally-integrated structure 14 of FIG. 5) is formed by spirally-winding a spunbonded polyester of continuous fibers with a polyamide. (The fibers are difficult to see in cross-section of FIG. 12 and 13 perhaps due to the fact that they are encapsulated in the elastomer). The polyester nonwoven was impregnated with an elastomer containing a minimal amount of blowing agent. It is believed that having a substantially large percentage (preferably at least 90%) of disconnected and generally spherical voids within the three-dimensional matrix of a nonwoven (continuous fibers) provides increased durability and resistance to smash (i.e. provides recovery when especially thick objects are accidently fed between the priming element and cylinder), as well as a more uniform compressive behavior across the printing element surface, than compressible layers having interconnected voids.

Figure 13:
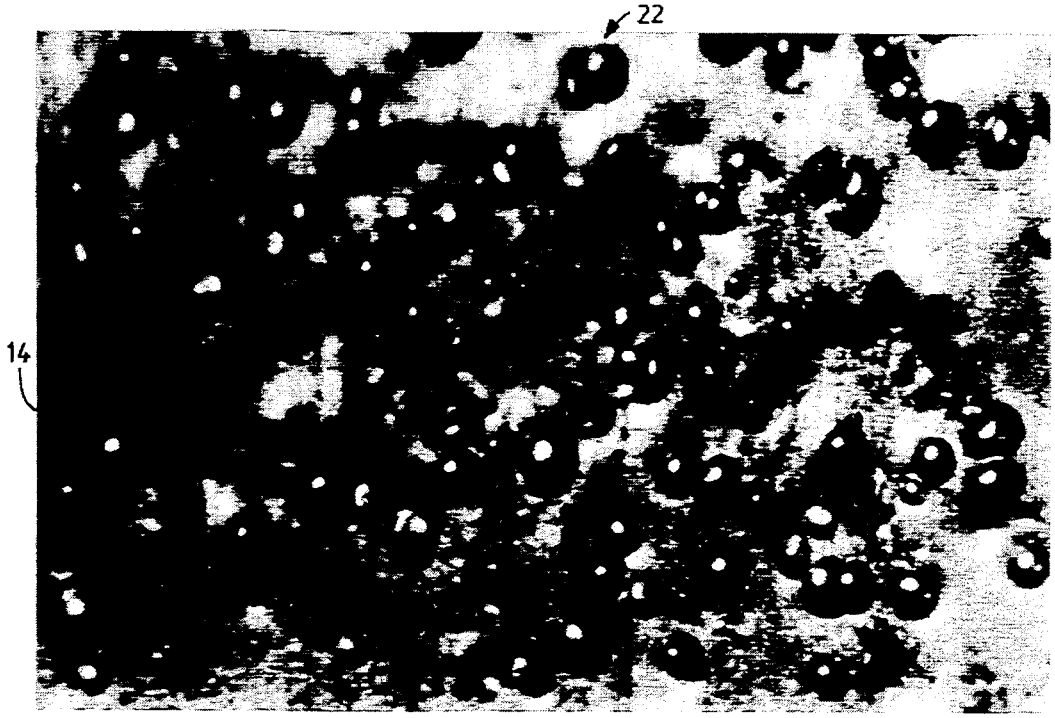

FIG. 13 is a further enlargement of the exemplary anisotropic foam of FIG. 12. Substantially spherical voids 22 are disconnected even though they may be immediately touching one another.

The formation of substantially disconnected spherical voids 22 is achieved by using a small percentage of blowing agent in the elastomer, in conjunction with an extremely porous nonwoven sheet. Preferably, 1.5 to 3.5 pans by weight (pbw) of blowing agent (e.g., CELOGEN TM O.T.) can be used per 100 pbw elastomer (e.g., nitrile rubber), and more preferably about 2.5–3.0 pbw blowing agent per 100 pbw elastomer is used. The preferred spunbonded nonwoven has a continuous filament structure that creates a path of least resistance helpful for the formation of substantially spherical bubbles 22. The preferred nonwoven 18 has a density, prior to elastomer impregnation, of 30–70 $g/m^2$, and a denier of 1–75 d. More preferably, it should have a density of 50 $g/m^2$ and a denier of 50 d. A polyester nonwoven coated with polyamide, which facilitates bonding of fibers or filaments together, is also preferred. Such is available from Akzo under the tradename Colback ®50. When impregnated with an elastomer such as nitrile robber, the resultant density of the impregnated nonwoven will be about 500 $g/m^2$. The spherical void volume in the foamed elastomer is preferably about 5–25% and more preferably about 15–20%.

Figure 10:
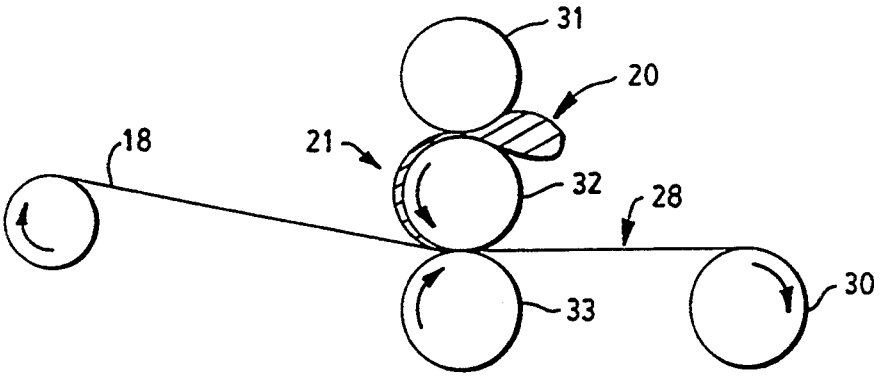

A further exemplary method for incorporating a void-containing elastomer into sheet 18 is shown in FIG. 10. A thermally softened elastomer 20 (e.g., a compounded nitrile robber including curing agent and blowing agent) is squeezed between opposed rollers 31 and 32 into a sheet 21 which is then squeezed into the nonwoven 18 and forced through opposed rollers 32 and 33. The gap distance between cylinders 31 and 32 should be about the same as the the gap distance between rollers 32 and 33 if it is desired that the elastomer thoroughly encapsulate the fibers. The impregnated sheet 28 is preferably passed between the rollers two to four times thereafter. This process can be used to impregnated robber into sheeting 18 comprised of nonwoven, woven, or knitted fabrics.

Figure 11:
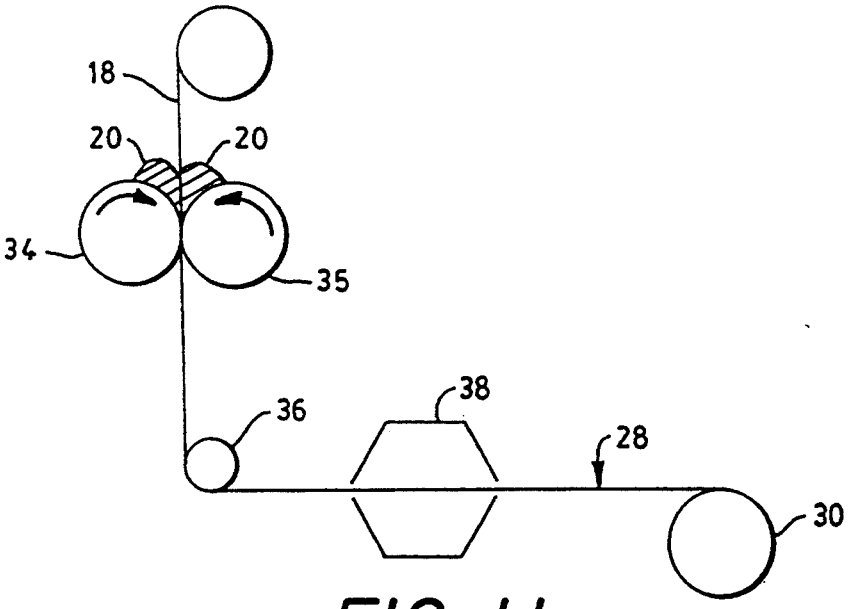

FIG. 11 illustrates a further exemplary method for placing a void-containing elastomer into a nonwoven sheet 18. The elastomer 20 is softened by using a solvent, and pressed into the openings and interstices of the nonwoven sheet 18 between opposed horizontally aligned cylinders or rollers 34 and 35. The impregnated sheet is optionally drawn around a guide roller 36, through a drying oven or zone 38, and taken up on a roller 30. The sheet 18 is fed downwards through opposed cylinders 34 and 35. The elastomer 20 and solvent are retained in the reservoir between the opposed rollers 34 and 35. Known solvents, such as toluene/methylchloride, may be used in amounts sufficient to allow the elastomer 20 to be pressed into the sheet 18. The impregnated sheet 28 can be pressed between the rollers two to four times to ensure that the elastomer has completely filled up the sheet 18.

Thus, an exemplary method for forming an exemplary printing element of the invention, comprises the step of providing a tubular form, such as a cylinder, mandrel, or carrier, and spirally wrapping a nonwoven sheet 18 that has been lastomer-saturated or -impregnated (such as by any of the above-described methods) at least two complete turns. Cotton or nylon strips are wrapped around the spirally wound elastomer-impregnated sheet 18, which is then cured such as by using an autoclave and suitable temperatures and pressures. The blowing agent-containing elastomer 20 is thereby foamed. The wrapping is removed, and the outer surface is preferably ground to ensure uniform circularity of the resultant spirally-integrated reinforced compressible tubular structure 14.

As discussed above, further exemplary printing elements have stratified spirally-integrated reinforced compressible structures 14 having alternating reinforcing sheets 18 and void-containing elastomer layers 20. In contrast to prior art blankets and methods, which employ a number of coating, curing, and/or grinding steps, the stratified structures of the invention can be obtained using a minimum number of steps (e.g. by using spiral windings of one or two layers having controlled thicknesses) and yet can be formed with relatively close tolerances.

An exemplary method for fabricating an anisotropic circumferentially endless printing element 10 of the invention comprises the steps of: (1) providing a tubular form comprising a cylinder 16, mandrel, or carrier sleeve; (2) forming a spirally-integrated reinforced compressible tubular structure 14 by spirally wrapping, using at least two complete turns circumferentially around the longitudinal axis of said tubular form, a sheet 18 having synthetic fibers, thereby defining an inner tubular surface 14A on a radially inward wrapped sheet portion 18A and defining an outer tubular surface 14B on a radially outward wrapped sheet portion 18B, and disposing a foamable elastomer 20 between the inner and outer tubular surfaces 18A and 18B defined by the inward and outward spirally wrapped sheet portions 14A and 14B; (3) curing the elastomer 20 so that it is foamed and spirally-integrated within the tubular structure 14; (4) optionally grinding the tubular structure to provide concentricity; (5) applying the outer printing surface layer 12; (6) curing the outer layer 12; and (7) optionally grinding and/or buffing the outer layer 12.

Another exemplary method for the spirally-integrated reinforced compressible tubular structure 14 comprises the steps of spirally wrapping, using at least three, and more preferably four to fifteen (depending upon final desired thickness), complete turns circumferentially around the rotational axis a laminate comprising a reinforcing sheet 18 having synthetic fibers and a layer of an uncured foamable elastomer, thereby forming a stratified spirally-wrapped multilayer structure; and thereafter curing the elastomer whereby the elastomer is foamed integrally and spirally-integrated within the reinforced compressible tubular structure. The use of nylon fabric having continuous fibers in warp and weft directions is the preferred woven sheet. The use of a spunbonded polyester is the preferred nonwoven sheet.

Exemplary spirally-integrated reinforced compressible layers 14 have a tensile modulus in the circumferential direction of 50–2000 megapascals. Preferably, the tensile modulus (See arrow B of FIGS. 1 and 2) is in the range of 100–400 megapascals (as determined in accordance with ASTM D638). The modulus of compression, in the radial direction (see arrow A) perpendicular to the plane of the layer, is preferably 5 to 50 megapascals, and more preferably 10 to 20 megapascals (as determined in accordance with ASTM D638).

As previously discussed, an exemplary printing element 10 of the invention may comprise an outer printing layer 12 and spirally-integrated reinforced compressible layer 14 mounted around a tubular carrier formed from an elastomer-impregnated sheet. The carrier can be made of an elastomer impregnated sheet spirally wrapped around, and after curing removed from, a mandrel. The sheet and elastomer materials may be the same as those described above. The tubular carrier should preferably have a modulus of at least 100 megapascals, and more preferably at least 200 megapascals, in the circumferential direction of rotation (ASTM D638).

Thus, an exemplary spirally-integrated reinforced compressible layer 14/carrier assembly can be mounted directly upon a cylinder without the use of additional carriers, such as tubular metal carriers which are known in the lithographic industry. Composite carriers may also be used.

It should be understood, however, that certain spirally-integrated reinforced compressible layers 14 may themselves have sufficient stiffness, e.g. a tensile modulus in the circumferential direction in the range of 100–400 megapascals or more, and more preferably at least 200 megapascals (ASTM D638), such that no further carrier or tube is needed for mounting the endless printing element 10 directly around a cylinder.

Exemplary printing elements of the invention may be used in combination with metal tubular carriers of the kind commonly used in the flexographic printing industry. These carriers can comprise nickel, steel-nickel alloys, steel, aluminum, brass, or other metals. Exemplary metal carrier walls should preferably have a thickness in the range of 0.01 to 5.0 mm. or more.

An exemplary method of the invention involves providing a metal carrier tube, such as one formed of nickel, mounting the carrier upon a mandrel, and forming the spirally-integrated structure 14 and outer surface layer 12, mid any additional layers, upon the mounted carrier.

Metal carrier surfaces are preferably first abraided (e.g., sandblasted, sanded, buffed, etc.) to obtain a matted finish, then degreased with a solvent (e.g., 1,1,1 trichloroethane, dichloromethane, isopropyl alcohol, etc.). The surface can be primed to promote rubber adhesion, using commercially available primers (such as Chemosil ®211 from Henkel Chemosil of Dusseldorf, Germany; ChemLock TM 205E from from Lord Corp., Erie, Pa.), followed by one or more layers of adhesive, such as a nitrile rubber dissolved in an appropriate solvent (e.g., toluene and dichloromethane).

Exemplary endless printing elements 10 of the invention may similarly be used with, or fabricated upon, nonmetal carriers. Thus, exemplary carriers may be made of rigid plastic materials such as unplasticized polyvinyl chloride (PVC), polycarbonate, polyphenylene oxide, polysulfone, nylon, polyester, or a mixture thereof. Other exemplary carriers comprise thermoset materials such as epoxies, phenolic resins, cross-linked polyesters, melamine formaldehyde, or a mixture thereof. Further exemplary carriers comprise elastomers such as ebonite, hard robber, nitrile rubber, chloro-sulfonated robbers, or a mixture thereof. Carriers may optionally be reinforced with fibrous materials, including chopped strand, nonwoven or woven mats, filament windings, or a combination thereof. Reinforcing fibers preferably comprise high modulus materials such as glass, metals, aramid fibers, or carbon fiber.

A further exemplary printing element/carrier of the invention may have a carrier comprising a prestretched heat-shrinkable material which may comprise, for example, polyethylene, polypropylene, or the like. The carrier may be foraged as a tube comprising one or more layers of the heat-shrinkable material that is cross-linked, then stretched in a heated state, and quenched (e.g., cooled to retain stretched diameter). When placed around a cylinder, the tube carrier can be heated and thereby shrunken to obtain a tight compression fit around a cylinder.

Exemplary carrier tubes used in conjunction with printing elements of the invention should preferably have an interference fit with the blanket cylinder in order to prevent slippage and subsequent misregister or doubling. The inside diameter of the carrier should be equal to or slightly less than the diameter of the cylinder shaft over which it will be fitted. The sleeve should preferably be resistant to creep and stress relaxation. To facilitate mounting on a cylinder, for example, metal carriers can be preheated to increase their effective diameter; and, after mounting, can be cooled to form a tight fit around the support shaft to minimize any potential vibration or axial and/or rotational movement. Optionally, the ends of the carrier tube may have notches, key ways, or similar features corresponding to shaped lugs, projections, key ways, or other locking features on the cylinder shaft to facilitate driving of the carrier-mounted printing element and avoid slippage. Preferably, air pressure exerted between the inner surface of the sleeve and the outer surface of the mandrel or cylinder would be used to temporarily expand the sleeve to allow it to be slid or pulled over a cylinder or mandrel.

In further exemplary printing element/carrier assemblies of the invention, the carrier tube has a longer length than the overlying printing element 10, such that the carrier extends longitudinally beyond one or both ends of the surrounding printing element. Thus, a clamping, keying, or locking device on the cylinder can be used to mechanically engage the longitudinally extended portion of the carrier tube to prevent slippage of the printing element/carrier assembly relative to the rotating cylinder.

The carrier thickness should be sufficient to withstand stresses imposed by the operation of the printing element and the mounting mode or device used, e.g. air pressure mounting, expandable mandrel, end clamps or end journals, etc. Known methods and devices may be used for mounting the exemplary printing elements and printing element/carrier assemblies of the invention. Typically, nickel carrier tubes may be about 0.12 mm thickness, while steel tubes may be about 0.15 mm. Rigid plastic carriers (e.g., unplasticized PVC) and hard elastomer carriers (e.g., ebonite) may be in the range of 0.5–2.0 mm, and preferably should have a modulus of elasticity of at least 200 megapascals.

It should be understood that filler layers may be used around cylinders to build up the thickness of the cylinder, but such filler layers should not be confused with the exemplary tubular carriers of the invention which facilitate mounting and dismounting of the printing elements.

Where individual components of the printing elements or carriers of the invention are not bonded together during fabrication (such as by being wet-coated, wet-applied, or cured together hi an autoclave ), they may be adhered to other components using known adhesives that are customarily employed in bonding elastomers to metals, rigid plastics, fabrics, and to other elastomers (e.g., epoxies). Adhesive layers may also be employed between the printing element and carrier or cylinder, or between the carrier and cylinder.

Exemplary adhesives include solvent-based systems employing synthetic elastomers (e.g. nitrile robbers, neoprene, block copolymers of styrene and a diene monomer, styrene butadiene copolymers, acrylics); anaerobic adhesives (e.g. adhesives which harden in the absence of oxygen without heat or catalysts when confined between closely fitted pans) such as butyl acrylates and, in general, $C_2$–$C_{10}$ alkyl acrylate esters; epoxies, e.g. one-pan resin adhesive systems, such as dicyanodiamide (cyanoguanidine), or two-pan systems employing a polyfunctional amine or a polyfunctional acid as the curative, or employing a cyanoacrylate); or a hot-melt adhesive such as polyethylene, polyvinyl acetate, polyamides, hydrocarbon resins, resinous materials, and waxes.

An exemplary adhesive layer which may be used on the inner surface of the spirally-integrated reinforced compressible tubular structure 14, or or upon the inner surface of a carrier tube, for mounting around a cylinder, may comprise a pressure-sensitive adhesive to insure easy assembly and removal. Such an adhesive can be, for example, a water-based acrylate/elastomer adhesive, which, when dried to a thickness of up to 200 microns, feels tacky and is pressure sensitive. Such adhesives are commercially available, from 3M, under the tradename Scotchgrip ®4235. Another exemplary adhesive is a polyurethane layer formed from polyisocyanate, elastomeric polyols and diol sprayed and cured on the cylinder or inner surface of the compressible layer or carrier. (Example: Adhesive formulation: Desmodur VL ®(Bayer) 100 pbw, Capa 200 ® (Interox Chemicals Ltd.) 300 pbw, Bisphenol A 40 pbw).

Adhesives may ,also be encapsulated in a coating material which permits the blanket and/or carrier to be conveniently slid onto a cylinder or core, and which, when broken, crashed, dissolved, or otherwise raptured, provides tackiness whereby rotational slippage of the blanket is minimized during operation. The encapsulating coating material may comprise, for example, a wax, protein, robber, polymer, elastomer, glass, or a mixture thereof.

The adhesive may be a continuous layer, or axially arranged in strips or beads (e.g., 2–5 mm. apart). An axial arrangement facilitates removal of a blanket from a cylinder or carrier tube once the useful life of the blanket has expired. Cylinders as well as carriers, especially metal ones, tend to be expensive, and the ability to reuse them conveniently, and without expensive preparatory labor in subsequent operations, is deskable.

EXAMPLE

An exemplary spirally-integrated reinforced compressible structure was made using a 0.25 mm thick spunlaid nonwoven (e.g, COLBACK TM 50). Nitrite rubber (100 pbw), carbon black (50 pbw), a blowing agent (2.8 pbw) (Celogen TM OT) and appropriate plasticizers, antioxidants, antiozonants, and curatives were combined in a mixer to obtain an elastomer impregnant. The elastomer was heated until it had a pasty consistency and rolled into a sheet, which was then rolled with the nonwoven between opposed rollers to force the elastomer into the nonwoven. The impregnated nonwoven was rolled three more times to ensure that the nonwoven was completely filled. The elastomer-impregnated nonwoven was wrapped around a cylinder at least six complete revolutions, and cotton strips were in turn wrapped around the nonwoven. The cylinder was placed into an autoclave to cure and foam the elastomer. The cured and foamed elastomer, which contained spherical voids, was ground to 1.46–1.48 mm thickness.

A compression endurance test comparison was then performed on both the spirally-integrated structure and a conventional compressible layer having short cellulose fibers and randomly-shaped, interconnected air volumes (Polyfibron T100). The samples were both subjected to five compressive cycles at a pressure of 20 bars between opposed plates. The samples were maintained under full compressive load for two minutes per cycle. The thickness was measured just after the test, 30 minutes after the test, and 24 hours later. The results, in terms of relative thicknesses at the stated periods, are as follows:

| | Short Fiber Layer | Spirally-Integrated |
|---|---|---|
| Starting thickness | 1.13–1.14 mm | 1.46–1.48 mm |
| Just after test | 1.08–1.10 mm | 1.45–1.47 mm |
| 30 minutes after test | 1.11–1.12 mm | 1.46–1.48 mm |
| 24 hours after test | 1.11–1.12 mm | 1.46–1.48 mm |

As indicated by the thickness measurements, the layer having the randomly-shaped interconnected voids and short fibers exhibited incomplete recovery from the compression test. In contrast, the spirally-integrated layer exhibited very resilient recovery immediately after the compression test, and full recovery within thirty (30) minutes after the test.

As modifications or variations of the foregoing examples, which are provided for illustrative purposes only, may be evident to those skilled in the art in view of the disclosures herein, the scope of the present invention is limited only by the appended claims.

We claim:

1. An anisotropic endless printing element comprising:

a seamless outer printing surface layer; and a spirally-integrated reinforced compressible tubular structure located beneath said outer layer, said spirally-integrated tubular structure comprising a sheet having synthetic fibers, said sheet being spirally wrapped at least two complete turns circumferentially around the longitudinal axis of said tubular structure, said spiral wrapping thereby defining an inner tubular surface on a radially inward wrapped portion of said sheet and defining an outer tubular surface on a radially outward wrapped portion of said sheet; and said tubular structure further comprising an elastomer having voids, said void-containing elastomer disposed between said inner and outer tubular surfaces defined by said wrapped sheet portions, said void-containing elastomer thereby being spirally-integrated within and providing radial compressibility to said tubular structure.

2. A printing element according to claim 1 wherein said sheet of said tubular structure comprises a nonwoven layer of randomly-oriented fibers forming a three-dimensional matrix having openings and interstices.

3. A printing element according to claim 2 wherein said fibers are continuous.

4. A printing element according to claim 3 wherein said nonwoven layer is spunbonded.

5. A printing element according to claim 2 wherein said void-containing elastomer is located within said openings and interstices of said three-dimensional matrix.

6. A printing element according to claim 5 wherein said void-containing elastomer comprises open and interconnected voids.

7. A printing element according to claim 5 wherein said void-containing elastomer is located within said openings and interstices of said three-dimensional matrix whereby said fibers are encapsulated.

8. A printing element according to claim 7 wherein said elastomer located within said three-dimensional nonwoven matrix has substantially spherically shaped voids distributed throughout in locations separate from said encapsulated fibers.

9. A printing element according to claim 7 wherein said nonwoven comprises a material selected from the group consisting of polyester, polyolefin, aromatic polyamide, polyvinyl chloride, rayon, polyvinyl chloride copolymer, vinylidene chloride, an aramid, graphite, glass, and a metal.

10. A printing element according to claim 9 wherein said spunbonded nonwoven layer comprises polyester fibers and an amide coating on said polyester fibers.

11. A printing element according to claim 1 wherein said element is further mounted around a tubular form selected from the group consisting of a carrier sleeve and gapless cylinder.

12. A printing element according to claim 11 wherein said tubular form is adhered by an adhesive selected from the group consisting of synthetic elastomers, anaerobic adhesives, epoxies, hot-melt adhesives, pressure-sensitive adhesives, or encapsulated adhesives.

13. A printing element according to claim 1 further comprising a stratified spirally-integrated reinforced compressible tubular section, wherein said sheet is spirally wrapped at least three complete turns circumferentially around the longitudinal axis of said tubular structure, thereby defining a radially innermost sheet portion, at least one intermediate sheet portion located radially outward of said innermost sheet portion, and an outermost sheet portion located radially outward of said at least one intermediate sheet portion; and said void-containing elastomer being disposed between said innermost sheet portion, said at least one intermediate sheet portion, and said outermost sheet portion, thereby forming a stratified spirally-integrated tubular structure.

14. A printing element according to claim 13 wherein said sheet of said tubular structure comprises a nonwoven layer of randomly-oriented filaments forming a three-dimensional matrix having openings and interstices, said nonwoven further comprising an elastomer within said three-dimensional matrix.

15. A printing element according to claim 14 wherein said nonwoven comprises continuous fibers.

16. A printing element according to claim 14 wherein said elastomer disposed within said three-dimensional matrix contains voids.

17. A printing element according to claim 14 wherein said sheet is wound at least five complete turns circumferentially around the longitudinal axis of said tubular structure thereby defining at least five sheet portions, said tubular section comprising a void-containing elastomer layer located between each of said spirally-wound sheet portions.

18. A printing element according to claim 13 wherein said sheet comprises a laminate that is spirally wound at least five complete tinges around the longitudinal axis of said tubular structure, said spirally wound laminate comprising a sheet of woven nylon fabric having continuous fibers in warp and weft directions.

19. A printing element according to claim 18 wherein said laminate is formed by providing a sheet of woven fabric, coating said fabric with an adhesive, and disposing against said fabric sheet an uncured elastomer layer containing a blowing agent.

20. A printing element according to claim 13 wherein said printing element is mounted around a carrier sleeve.

21. A printing element according to claim 13 wherein said printing element is mounted around a gapless cylinder.

22. A method for fabricating a tubular printing element, comprising the steps of:

providing a tubular form comprising a cylinder, mandrel, or carrier sleeve;

forming a reinforced compressible tubular structure by spirally wrapping, using at least two complete turns circumferentially around the longitudinal axis of said tubular form, a sheet having synthetic fibers, said spiral wrapping thereby defining an inner tubular surface on a radially inward wrapped sheet portion and defining an outer tubular surface on a radially outward wrapped sheet portion, and disposing an elastomer between said inner and outer tubular surfaces defined by said inward and outward spirally wrapped sheet portions, and curing said elastomer such that in its cured form said elastomer contains voids and is spirally-integrated within said tubular structure.

23. A method according to claim 22 wherein the step of forming a reinforced compressible tubular structure further comprises providing a nonwoven layer of randomly-oriented filaments forming a three-dimensional matrix having openings and interstices.

24. A method according to claim 23 wherein said nonwoven layer comprises continuous filaments.

25. A method according to claim 23 further comprising the step of providing said foamable elastomer within said openings and interstices of said three-dimensional matrix of said nonwoven sheet, and curing said elastomer to produce voids.

26. A method according to claim 22 further comprising the step of providing open and interconnected voids in said void-containing elastomer.

27. A method according to claim 22 further comprising the step of saturating said nonwoven layer in a water-based latex containing an elastomer, squeezing said saturated nonwoven layer between opposed surfaces, allowing said latex to dry, and curing said elastomer.

28. A method according to claim 26 further comprising the step of impregnating said nonwoven layer with an uncured elastomer latex containing a curing agent, and activating said curing agent.

29. A method according to claim 25 further comprising the step of impregnating said nonwoven layer with a thermally softened elastomer having a blowing agent, and activating said blowing agent while curing said elastomer, whereby voids are formed in said cured elastomer.

30. A method according to claim 29 wherein said nonwoven layer comprises polyester fibers having an amide coating.

31. A method according to claim 25 further comprising the step of impregnating said nonwoven layer with a solvent-softened curable elastomer composition having a blowing agent, and activating said blowing agent, whereby voids are formed in said elastomer.

32. A method according to claim 25 wherein said nonwoven layer comprises polyester filaments having an amide coating.

33. A method according to claim 22 wherein said tubular form comprises a carrier sleeve, said carrier sleeve comprising an elastomer reinforced by fibers.

34. A method according to claim 22 wherein said step of forming said spirally-integrated reinforced compressible tubular structure further comprises the step of spirally wrapping, using at least three complete turns circumferentially around said axis, a laminate comprising said sheet and a layer of an uncured foamable elastomer, thereby forming a stratified structure, and thereafter curing said elastomer whereby said elastomer is foamed and spirally-integrated within said reinforced compressible tubular structure.

35. A method according to claim 34 wherein, in said step of forming said tubular structure, said sheet comprises a nonwoven layer of randomly-oriented fibers forming a three-dimensional matrix having openings and interstices, and further comprises an elastomer within said three-dimensional matrix.

36. A method according to claim 35 wherein said nonwoven layer comprises continuous fibers.

37. A method according to claim 35 wherein said elastomer within said three-dimensional matrix contains voids.

38. A method according to claim 34 wherein said laminate is wrapped at least five complete turns circumferentially around said axis, said laminate comprising a woven fabric having continuous fibers in warp and weft directions.

39. A method according to claim 34 wherein said tubular form comprises a carrier sleeve, said carrier sleeve comprising an elastomer reinforced by fibers.

* * * * *